US005739446A

United States Patent [19]

Bahnson

[11] Patent Number: 5,739,446

[45] Date of Patent: Apr. 14, 1998

[54] HARMONICA AND METHOD OF PLAYING SAME

[76] Inventor: Henry T. Bahnson, 612 Dorseyville Rd., Pittsburgh, Pa. 15238-1618

[21] Appl. No.: 886,631

[22] Filed: May 21, 1992

[51] Int. Cl.[6] ..... G10D 7/12

[52] U.S. Cl. ..... 84/377

[58] Field of Search ..... 84/377, 378

[56] References Cited

U.S. PATENT DOCUMENTS

| | | | |
|---|---|---|---|
| 574,625 | 1/1897 | Paris | 84/377 |
| 1,623,175 | 4/1927 | Friedel | 84/377 |
| 1,671,309 | 5/1928 | Newman | 84/377 |
| 1,752,988 | 4/1930 | Haussler | 84/377 |
| 2,005,443 | 6/1935 | Steele | 84/377 |
| 2,339,790 | 1/1944 | Magnus | 84/377 |
| 2,675,727 | 4/1954 | Beker et al. | 84/377 |
| 3,580,125 | 5/1971 | Heatwole | 84/377 |
| 3,674,910 | 7/1972 | McKenzie | 84/377 |

*Primary Examiner*—Cassandra C. Spyrou
*Attorney, Agent, or Firm*—Arnold B. Silverman

[57] ABSTRACT

A harmonica including damping means for producing pure overblow and/or overdraw tones and making such tones less difficult to produce. The harmonica includes at least one slide which damps at least one blow reed corresponding to a draw reed which vibrates during an overblow procedure. The harmonica may also include a second slide, a draw reed slide which damps at least one draw reed to allow vibration of a blow reed during an overdraw procedure. A method of overdrawing and overblowing is also disclosed.

34 Claims, 6 Drawing Sheets

HARMONICA AND METHOD OF PLAYING SAME

FIELD OF THE INVENTION

The present invention relates to musical instruments, and most particularly to harmonicas adapted for improved playing and to improved methods of playing harmonicas.

BACKGROUND OF THE INVENTION

The harmonica is one of the most popular musical instruments in the United States and possibly the entire world. One form of the harmonica is the ten-hole diatonic, in which twenty reeds produce nineteen natural tones, with one tone being duplicated. The ten-hole diatonic harmonica typically has ten blow reeds, which sound in response to air blown into the harmonica by positive oral pressure and ten draw reeds, which sound in response to air drawn in through the harmonica by negative oral pressure. The nineteen tones allow the player to play all the diatonic tones of a middle octave and most of the tones of a lower and a higher octave.

A moderately advanced diatonic harmonica player can produce twelve additional tones by a process known as "bending," whereby the player modifies the resonant volume in the vocal passage, principally with the tongue, to "bend" or adjust the tone produced to achieve the desired pitch.

A more advanced player can also produce four additional tones by a technique known as "overblowing," whereby the player more strictly matches the appropriate resonant volume with the tone he or she wishes to produce, causing the draw reed of the first, fourth, fifth, and sixth holes to produce tones corresponding to a flatted third of the low octave and a flatted third, fifth, and seventh respectively of the middle octave. Similarly, drawing and a strictly controlled shaping of the resonant passage will produce "overdraw" tones from the blow reeds corresponding to a sharped first, fifth and eighth of the highest octave. On an ordinary C harp the overblow tones are Eb-4 of the low octave, Eb-5, F#-5 and Bb-5 of the middle octave, and the overdraw tones are C#-6, G#-6 and C#-7 of the highest octave. Overblow and overdraw tones can be produced from all holes of the diatonic harmonica, but except for those listed, tones can be produced more easily with other techniques.

In all, the most skilled diatonic harmonica player can produce a total of thirty-eight tones from the ten-hole diatonic harmonica, using the normal playing, bending, overblowing, and overdrawing techniques. These tones and the methods of producing them are illustrated in FIG. 1.

A problem with any musical instrument, including the diatonic harmonica, is that not all players are highly skilled or even moderately advanced at playing the instrument, and a majority of instrument players are at skill levels far below the advanced level and cannot significantly improve their skills even with much practice.

The technique of "overblowing" is extremely difficult and diatonic harmonica players, even those of great skill, have been known to practice the technique for years before feeling comfortable enough to use the technique in a live performance. The same can be said of the "overdrawing" technique.

Because the seven tones achieved by overblowing or overdrawing are not readily achieved on a ten-hole diatonic harmonica, many less-advanced players resort to a chromatic harmonica, which offers a full chromatic scale of semitones by means of a slide that directs air to reeds pitched a semitone higher than those activated without the slide.

However, the chromatic harmonica is not as adaptable as the diatonic to musical expression, characteristic of the blues and country harmonica music. Although the chromatic scale is easier to play on the chromatic harmonica than on the diatonic, its more limited expression makes it less enjoyable for many, both listeners and players.

A number of devices have been used to improve the playing of harmonicas. Paris, U.S. Pat. No. 574,625, discloses a siding mouthpiece for transferring a blast of air from one cell chamber to another without moving the lips.

Newman, U.S. Pat. No. 1,671,309 discloses a chromatic harmonica having a frontal slide which occludes certain blow holes in the harmonica to allow the player to achieve a chromatic scale, as opposed to a diatonic scale. Other chromatic harmonicas having blow hole-occluding devices include U.S. Pat. Nos. 1,752,988; 2,005,443; 2,339,790; and 2,675,727.

Until now, however, the prior art has not addressed easing the difficulty of overblowing or overdrawing on the diatonic harmonica.

Accordingly, an advance in the art could be realized if a device could be developed making less complicated the process of overblowing and/or overdrawing on the diatonic harmonica, enabling even the player having limited skills to achieve the characteristic expression of the diatonic harmonica and yet realize the full half tone scale capability of the chromatic harmonica.

It is an object of the invention to produce an improved method of playing a diatonic harmonica.

It is another object of the invention to provide an improved method of overblowing and/or overdrawing a harmonica.

It is yet another object of the invention to provide a harmonica that permits the overdrawing and overblowing techniques of the invention to be practiced without otherwise requiring any significant changes in playing techniques.

It is still a further object of the invention to provide a harmonica more susceptible to the technique of overblowing and/or overdrawing.

It is yet another object of the invention to provide a method of damping certain reeds of the harmonica to achieve improved overblowing and/or overdrawing.

These and other objects of the invention will become more readily apparent as the following detailed description of the preferred embodiments proceeds.

SUMMARY OF THE INVENTION

It has been determined, surprisingly, that the overblowing phenomenon in diatonic harmonicas is produced not by the blow reeds, rather from the draw reeds, that is, those reeds on the harmonica that normally produce sound with negative oral pressure. Conversely, and equally surprisingly, the overdraw tones of the high octave are produced from the blow reeds. It has been determined that the overblow and overdraw tones are produced more easily when the less functional reed is damped. This means blocking the blow reed on first, fourth, fifth and sixth hole overblows and blocking the draw reed on seventh, ninth and tenth hole overdraws.

In a preferred embodiment of the invention, certain of the reeds are damped by occluding their reed slot with slide mechanisms, one for the blow reeds and one for the draw reeds. In another embodiment, certain of the reeds are damped by a series of pads connected to the slide, and in another embodiment a pad is rotated to cover certain reed slots and thus damp its reed.

The slide may be adapted with a spring or other means to return the slide to a non-damping position following the damping of the reeds. The player activates the slide with his or her finger, damping and undamping the reeds.

It is possible using the advantages of the invention to produce purer overblow and overdraw tones, to produce the tones more easily, to produce the tones with less air pressure, and to learn more quickly how to produce the necessary configuration of the vocal tract.

In a preferred method of practicing the invention, the player damps one or more reeds, such as a blow reed, without damping all the blow reeds and overblows into the cavity (blow hole) corresponding to the damped reed, causing the draw reed directly opposite the damped blow reed to vibrate, producing an overblow tone. The cavity communicates with both the damped blow reed and the draw reed made to vibrate through overblowing. The same method may be practiced in an overdrawing technique, in which one or more draw reeds is damped, and the blow reed directly opposite the damped draw reed and sharing a cavity with it is made to vibrate by overdrawing, producing an overdraw tone.

BRIEF DESCRIPTION OF THE DRAWINGS

A full understanding of the invention can be gained from the following description of the preferred embodiments when read in conjunction with the following drawings wherein.

DETAILED DESCRIPTION OF THE PREFERRED EMBODIMENTS

Figure 1:
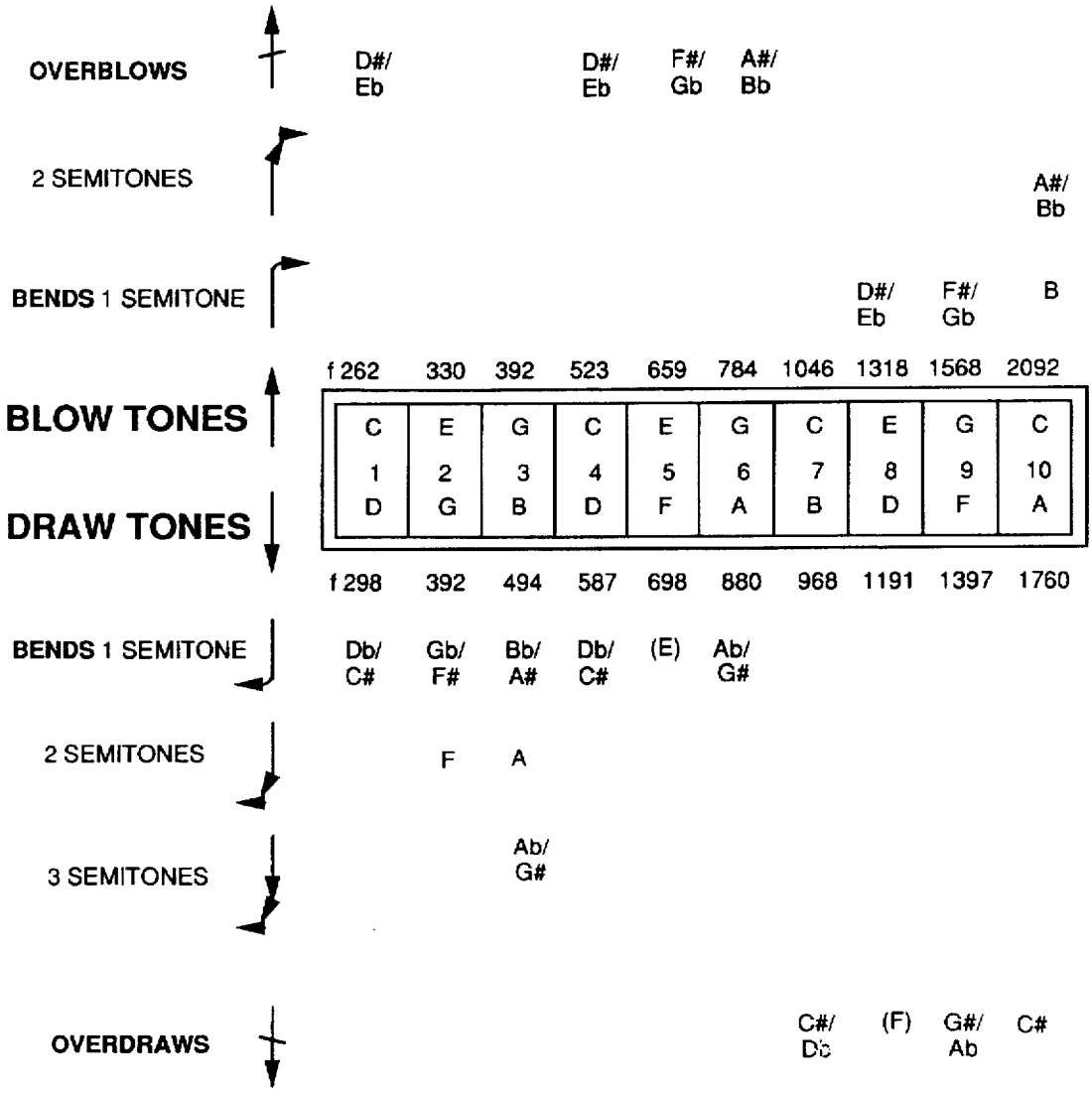
FIG. 1 is a schematic representation of the tones that can be played on a diatonic harmonica using the present invention, and the method of playing them.

In using the harmonica of the invention, only holes of the seven reeds corresponding to the four overblow tones and the three overdraw tones are damped by the slide. On the C major harp, these are the blow reeds of the first hole, C–D; fourth hole, C–D; fifth hole, E–F; sixth hole G–A and the draw reeds of the seventh hole C–B; ninth hole,, G–F; and tenth hole, C–A. See FIG. 1. The remaining reed slots remain open.

Reeds of a harmonica naturally function as closing reeds, that is, the reed is blown or drawn into the reed slot, shutting off the flow of air which allows the reed to spring back at a rate determined by its natural frequency. With overblowing, as with overdrawing, the reed functions as an opening reed, which requires more energy; this energy is obtained by maximizing the resonant energy of the vocal tract and matching it with impedance of the reed.

The invention is applicable to diatonic harmonicas that employ single reeds for each tone. The advantages of the complete chromatic scale that the invention facilities are best realized with harmonicas tuned with equal temperament intonation.

Figure 2:
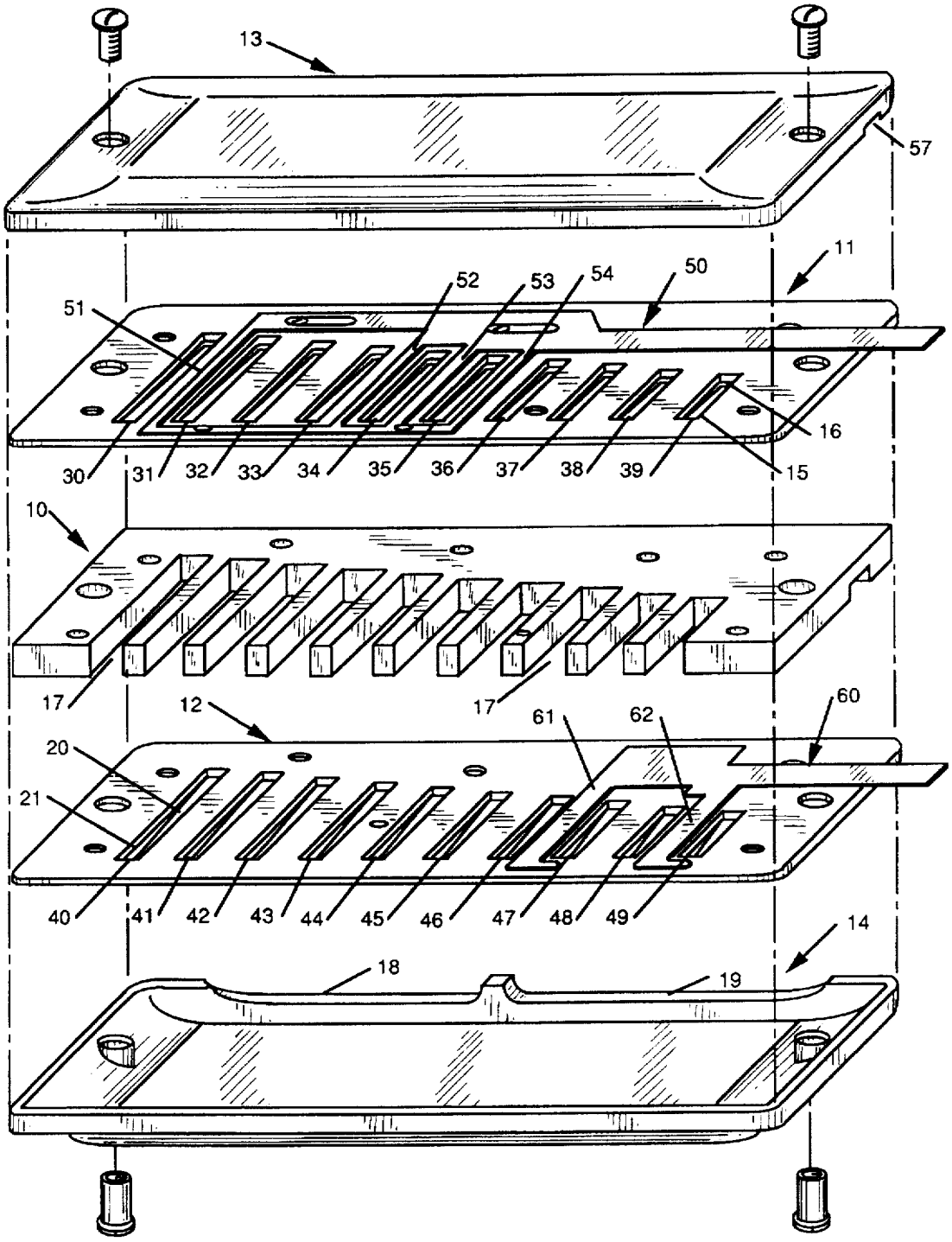
FIG. 2 is an isometric exploded view of a preferred embodiment of the invention showing a harmonica with a blow reed slide and a draw reed slide.

FIG. 2 illustrates a schematic, exploded view of a diatonic harmonica of the invention consisting of a body or "comb" shown generally at 10, fabricated of wood, plastic or metal, sandwiched between two plates, generally brass, and comprising a blow reed plate shown generally at 11, and a draw reed plate shown generally at 12, which in turn are sandwiched within a housing comprising an upper cover 13 and a matching lower cover 14.

Figure 3:
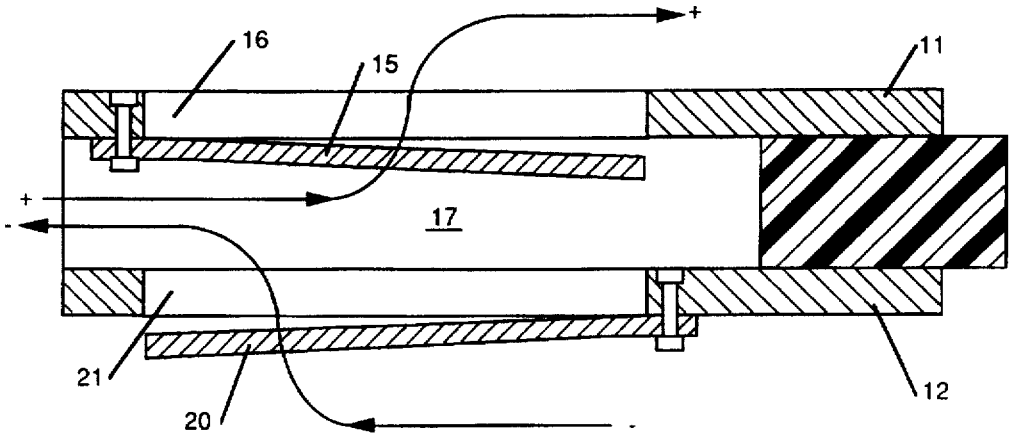
FIG. 3 is a cross sectional view of a preferred embodiment of the invention, showing the relationship of the blow reed and draw reed in the harmonica cavity and air flow patterns.

The blow reed plate 11 contains a plurality of blow reed cells, 30–39, each accommodating a blow reed 15 in a blow reed slot 16. The blow reeds 15 are mounted on the blow reed plate 11 such that when the blow reed plate 11 is positioned atop the body 10, the blow reeds are positioned on the inside of grooves 17 contained in the body 10. As illustrated in FIG. 3, these grooves 17 comprise cavities, which allow air passage into and out of the harmonica through blowing and drawing, respectively. The arrows labelled with a "+" sign in FIG. 3 illustrate positive air flow through the harmonica, while the arrows labelled with a "–" sign illustrate negative oral pressure through the harmonica.

Correspondingly, as shown in FIGS. 2 and 3, the draw reed plate 12 has within it a series of draw reed cells, each comprising a draw reed 20 in a draw reed slot 21. The draw reeds 20 are mounted on the outside of the draw reed plate 12 relative to the body 10. The draw reeds 20 naturally vibrate only when the harmonica player draws air into the harmonica, in the direction of arrows labelled with a "–" sign in FIG. 3.

A pair of air inlets, 18 and 19 in FIG. 2, cut out of the harmonica lower cover 14 and the corresponding upper cover 13 allow air to pass out of the harmonica during blowing and into the harmonica during drawing.

For convenience, the positions of the individual blow reeds 15 are labeled 30 through 39 and the positions of the corresponding draw reeds 20 are labeled 40 though 49, as illustrated on FIG. 2. Each blow reed 15, for example that in position 30, has a corresponding draw reed 20, for example that in position 40, positioned directly opposite the blow reed, such that the matched pair of reeds share a common cavity 17. The cavity 17, as illustrated in FIG. 3 communicates with both a blow reed 15 and a draw reed 20 in a matched pair.

As previously stated, the draw reeds in positions 40–49 normally sound only when air is drawn into the harmonica. That is the way the diatonic harmonica is designed to operate. However, it has been established that during an overblow procedure, wherein the resonance of the vocal tract is critically altered and pressure is increased, certain of the draw reeds can be made to vibrate a semitone higher than this natural frequency. Conversely, certain blow reeds can be made to produce overdraw tones a semitone higher than their natural frequency.

Unexpectedly, it has now been found that the overblow and overdraw tones produced by this technique may be more easily achieved and made more pure by damping the less functional reed in the same cavity 17, as shall subsequently be described.

A preferred embodiment for producing the improved harmonica tones of the invention is illustrated in FIG. 2, comprising a slide 50 positioned on the outside surface of the blow reed plate 11 relative to the body 10. The slide 50 has a series of dampers 51, 52, 53 and 54, which are sized and positioned to effectively close off certain of the blow reed slots 16 and to damp the corresponding blow reeds within those openings.

Figure 4:
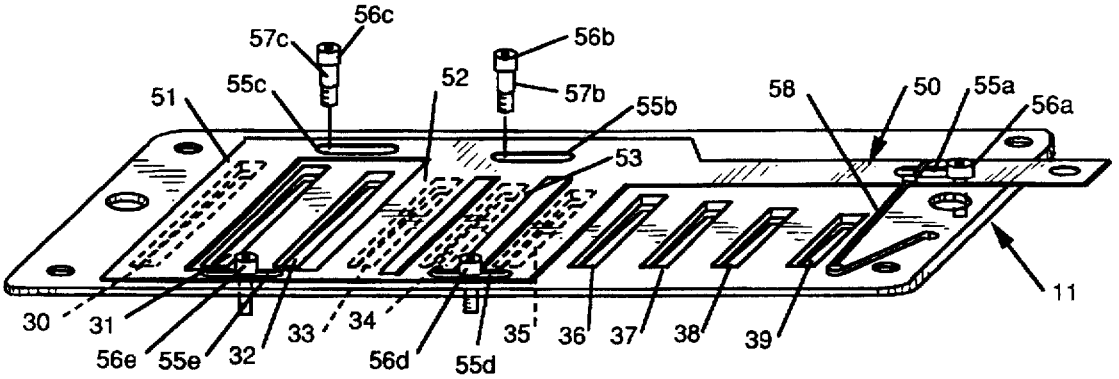
FIG. 4 is a schematic, exploded isometric view of a preferred blow reed plate fitted with a spring-loaded blow reed slide of the present invention.

In the embodiment illustrated in FIG. 2, the blow reed slide 50 has four dampers 51, 52, 53, and 54 corresponding to the blow reed positions 30, 33, 34, and 35 respectively as shown in FIG. 4. In use, the slide 50 is moved to the left such that the dampers 51, 52, 53, and 54 close the blow reed slots corresponding to the blow reed positions 30, 33, 34, and 35, respectively, as shown in FIG. 4. The slide 50 is preferably fitted with an automatic returning mechanism, such as a spring 58 which returns the slide from a damped position as seen in FIG. 4 to a disengaged or rest position, illustrated in FIG. 2.

Figure 5:
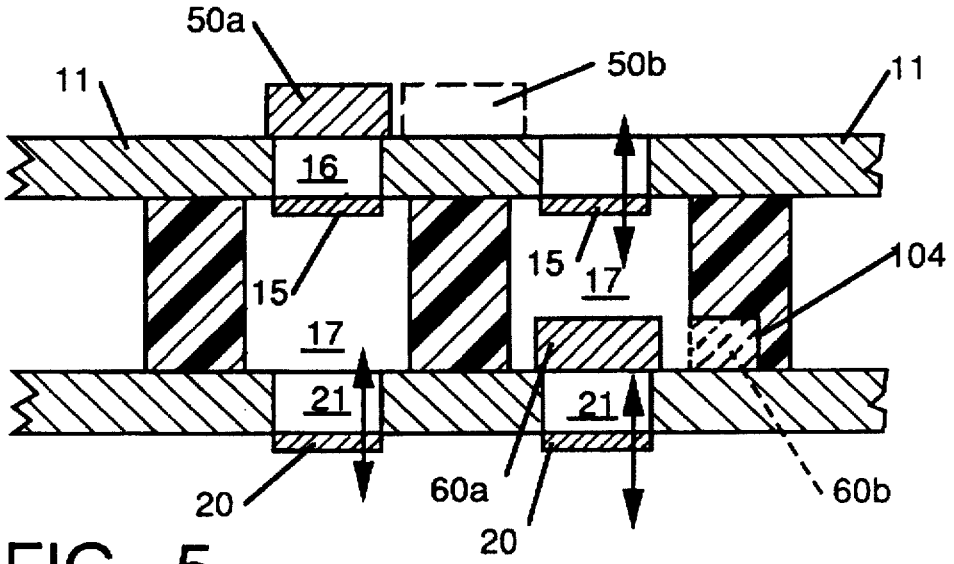
FIG. 5 is a schematic transverse frontal cross sectional view of a portion of a harmonica of the invention, taken at holes #6 and #7.

As illustrated in FIGS. 2 and 5, the dampers 51, 52, 53, and 54 on the slide 50 comprise elongated members sized precisely to cover effectively the entire blow reed slot 16 of the blow reed plate with which each is associated, and yet are not oversized, allowing the dampers to remain out of the way when the slide 50 is disengaged from the blow reed openings 16. FIG. 5 illustrates a blow reed slide in the engaged position **50*a* over a blow reed slot 16 (hole no. 6) and in the rest position 50*b*** in phantom.

The embodiment illustrated in FIG. 2 permits the overblow technique of the invention to be practiced most effectively on draw reeds in positions 40, 43, 44 and 45, those reeds corresponding to the blow reeds in positions 30, 33, 34, and 35 having their reed slots 16 closed by the dampers 51, 52, 53, and 54 of the slide 50. The dampers 51–54 of the invention close only the blow reed slots 16 in the blow reed plate 11, but do not close the cavities 17 in the body 10, such that air is not precluded from otherwise entering or leaving any of the cavities 17. Furthermore, the dampers 51–54 of the slide 50 close only some of the blow reed slots 16 in the blow reed plate 11, not all of the blow reed slots 16. Even when the slide 50 is engaged, covering certain of the blow reed slots 16, the blow reeds 15 corresponding to unobstructed blow reed slots 16, for example those in positions 31, 32, and 36–39, may be played normally.

Figure 6:
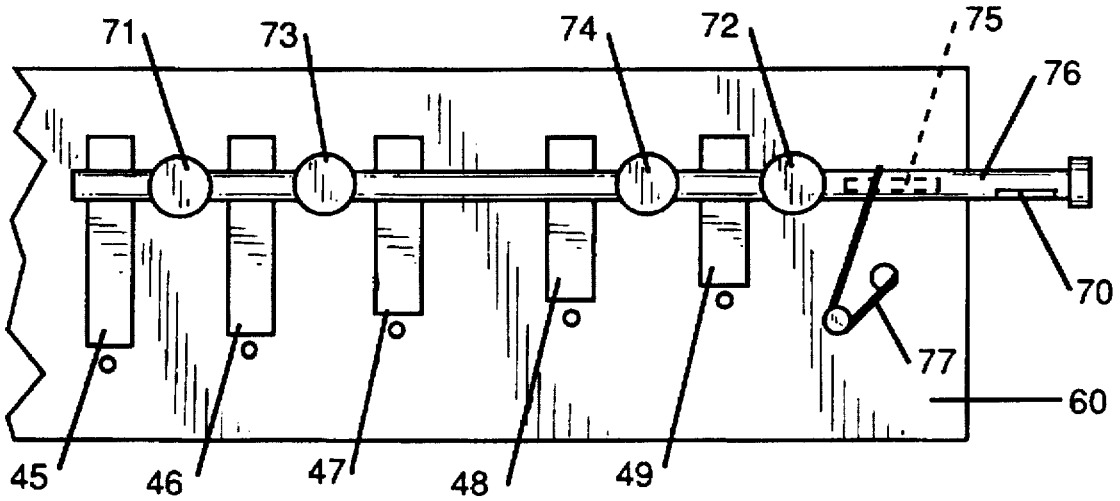
FIG. 6 is a schematic view of a draw reed plate and a draw reed slide fitted with damper pads according to the invention.

The blow reeds are attached to the inside surface of the blow reed plate. It is, therefore, possible to put a slide on the smooth outside surface of the blow reed plate. This is done in a preferred embodiment of the invention. The draw reeds, however, are placed on the outside of the draw reed plate and prohibit the application of a slide. Damping pads can be slid over the vibrating ends of the reeds and this has been found effective, as illustrated in FIG. 6. A highly preferred design for the draw reed slide is to accurately mill a recess in the comb to accommodate the slide on the inside of the draw reed plate as in FIG. **7*a***.

Figure 7A:
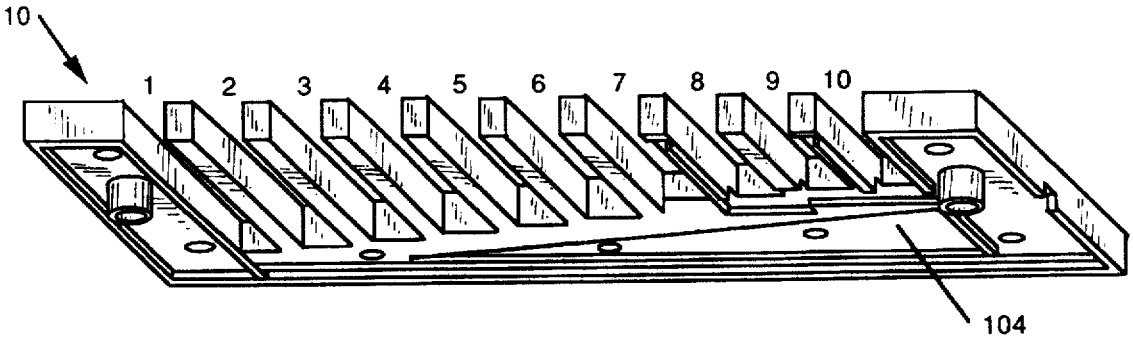
FIG. 7A is an isometric view showing the milled underside of a harmonica comb.
Figure 8:
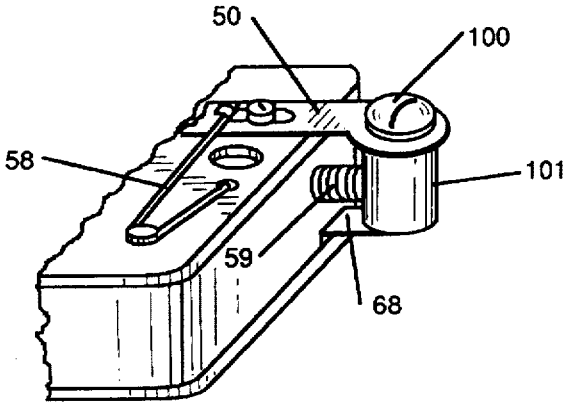
FIG. 8 is an isometric view of a portion of a harmonica of the invention.
Figure 9:
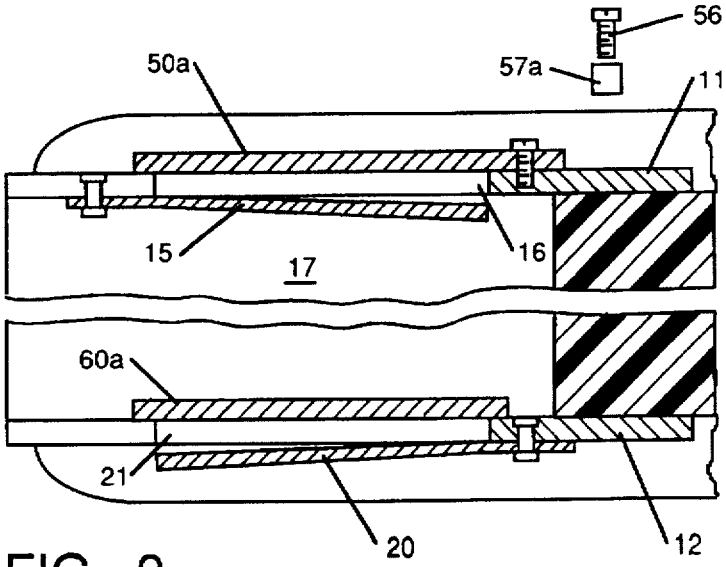
FIG. 9 is a schematic transverse cross sectional end view of a portion of a harmonica of the invention.

FIGS. 7 and 8 further illustrate another version of a preferred embodiment of the invention, wherein the blow reed slide 50 and draw reed slide 60 may be connected with a pair of screws 100 threaded with a spacer 101 positioned between the ends of the blow reed slide 102 and draw reed slide 103, respectively. As illustrated in FIG. 7A, the underside of the comb 10 may be milled with groves 104 sized to slidably accept the draw reed slide 60. See also FIG. 5, which illustrates the draw reed slide **60*a* in the engaged position over a draw reed slot 21 (hole no. 7) and shows in phantom the draw reed slide 60*b* in the resting position within the milled groove 104. See also FIG. 9, showing the engaged blow reed slide 50*a* and draw reed slide 60*a* over a blow reed slot 16 and draw reed slot 21**, respectively.

Figure 12:
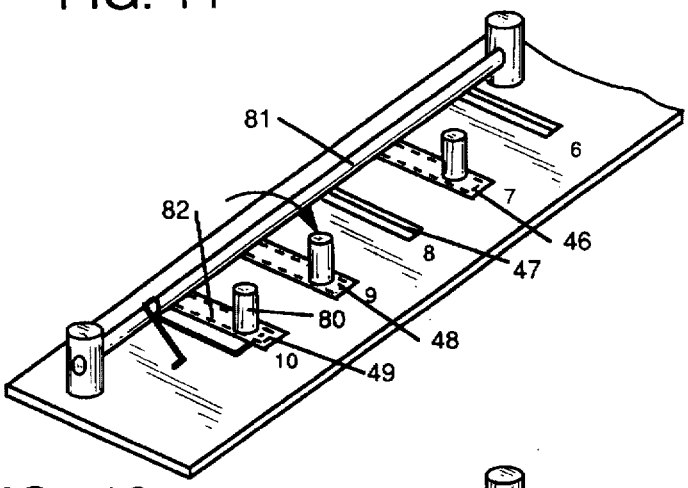
FIG. 12 is a schematic isometric view of an alternative embodiment of the invention wherein a damper pad is rotated into a damping position with respect to a reed.
Figure 13:
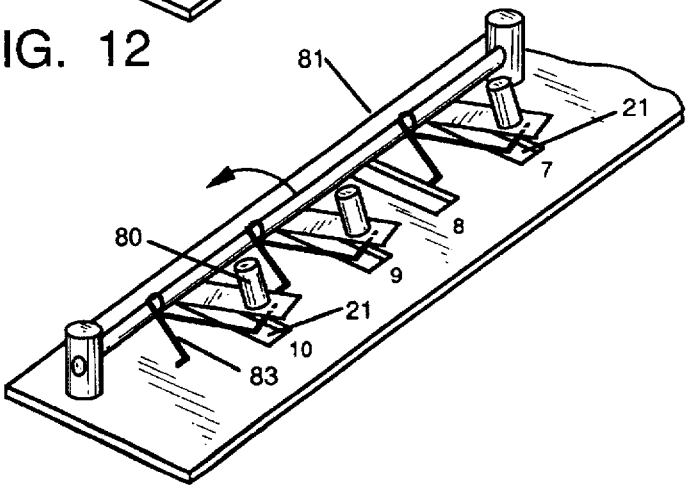
FIG. 13 is a schematic isometric view of the embodiment of FIG. 12 showing the damper pad rotated away from the reed.

Some diatonic harmonica players also play a chromatic model. To avoid confusion from buttons and slides that look similar but function in vastly different ways a cover may be rotated into place over the reed slot in order that the button 80 protrudes at a right angle from the cover as illustrated in FIGS. 12 and 13.

Figure 10:
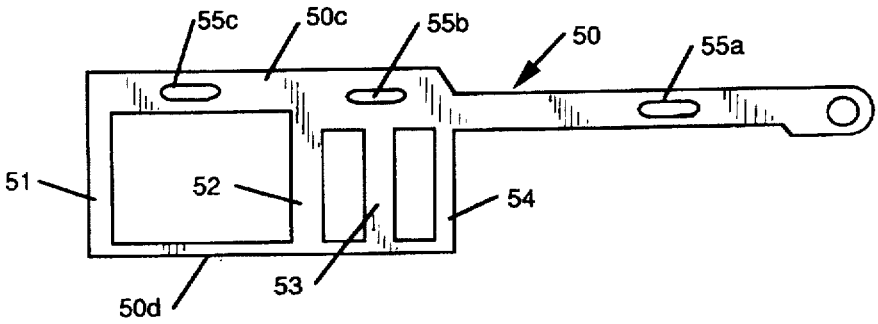
FIG. 10 is a plan view of a preferred blow reed slide of the invention.

FIG. 10 illustrates a more detailed representation of the blow reed slide 50 of FIGS. 2, 4 and 7. As illustrated, the slide 50 may include a plurality of slots **55*a–c* for receiving a pin, screw or other fastening means 56*a–c*, respectively, which slidably attach the slide 50 to the blow reed plate 11. As also seen in FIG. 10, the blow reed slide 50 includes a sliding member 50*c* to which each of the damping members 51–54 is connected, at substantially right angles to the sliding member 50*c*. The slide 50 further includes a reinforcing member 50*d* which is substantially parallel to the slide member, spaced therefrom, and is connected to the damping members 51–54**.

FIG. 4 illustrates in detail the blow reed plate 11 of FIG. 2 fitted with a blow reed slide 50. In the embodiment shown in FIG. 4, a slot, such as **55*b*, slidably receives a small screw, such as 56*b*, which snugly fits inside a metal collar 57*a* which in turn fits inside the slot 55*b*. As illustrated in FIG. 4, the slide 50 may include a plurality of slots 55*a–e*, each of which receives a fastener or screw 56*a–e*, respectively, and a metal collar, such as 57*b*. The length of the collar 57*b* may be altered to adjust friction against the slide 50 when the screw 56*b* is tightened in place. The screws 56*a–e* are threaded into threaded openings in the blow read plate 11** (not shown).

The length and position of the slots **55*a–e* on the slide 50, in conjunction with positions of the threaded holes in the blow reed plate, determine length of travel of the slide and its position relative to reed slots 16**.

The blow reed slide 50 is fitted with a return device, such as a spring 58 which allows the slide 50 to be returned to a non-damping or rest position following damping of the particular reed or reeds.

FIG. 8 illustrates another view of a preferred embodiment having, in addition to the spring 58, a helical spring 59 to assist in returning the slides 50 and 60 to the rest position.

A preferred embodiment of the invention includes, in addition to a slide 50 for overblowing, a second slide 60 for producing purer tones more easily through overdrawing. Like the overblow slide 50, the overdraw slide 60 has one or more dampers sized and positioned to damp one or more draw reeds 20 by covering the corresponding draw reed slot 21.

Figure 11:
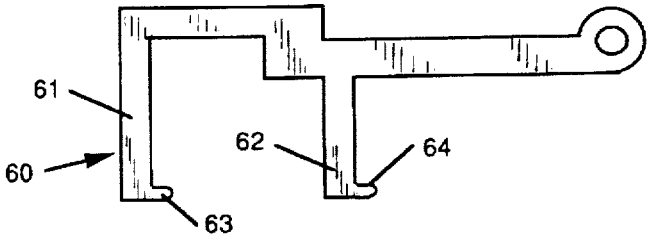
FIG. 11 is a plan view of a preferred draw reed slide of the invention.

In the embodiment of FIG. 2, the draw reed slide 60 has two dampers 61 and 62 sized and positioned to cover the draw reed slots 21 corresponding to draw reed positions 46 and 48, respectively. In a highly preferred embodiment of the invention, the draw reed slide 60 has a third damper for covering the draw reed slot 21 corresponding to draw reed position 49. FIG. 11 illustrates in greater detail the draw reed slide 60 of FIG. 2, having dampers 61 and 62. Dampers 61 and 62 each include a tongue, 63 and 64, respectively, to guide the slide after engagement to its resting position.

It has been determined that the overdraw slide 60 of the FIG. 2 embodiment will allow a player to produce purer overdraw tones more easily on the blow reeds associated with positions 36, 38 and 39. That is, when the overdraw technique is used, the vocal tract is appropriately configured, and air is drawn in through the harmonica with such force that the blow reed in positions 36, 38 and 39 is made to vibrate, producing the tones on a C harp of C#-6, G#-6 and C#-7, respectively. By damping the corresponding draw reed in positions 46, 48, or 49, and with the overdraw technique, these blow reeds produce a more pure sound more easily.

The overblow and overdraw techniques can be used on all holes of the diatonic harmonica, but the desired tones can be produced more easily by normal blow and draw, or by draw or blow bending except for the tones described, on a C harp Eb-4,-Eb-5, F#-5, Bb-5, C#-6, G#-6, and C#-7 from holes 1, 4, 5, 6, 7, 9 and 10 respectively.

The slides 50 and 60 are preferably fabricated of brass or any other resilient material suitable for the purpose, which can be stamped or molded, such as metal or plastic, or machined by electric discharge, such as brass or graphite. The slides 50 and 60 should be thin, to prevent adding too much weight to the harmonica, about 0.80 to 1.02 mm, and to enable the slide to pass more freely between the housing and the blow reed plate. A lubricant, such as vaseline, may be used to ease friction on the slides 50 and 60 but is usually not necessary.

When the draw reed slide 60 is used, it is preferred that the body 10 be milled on its underside to accept the thickness of the slide 60. Such milling is not required with the blow reed slide 50, as the outer surface of the blow reed plate is flat and unencumbered with reeds, and the upper cover 13 provides enough clearance for the slidable motion of the slide 50. It may be necessary, however, to cut a small opening 57 in the upper cover 13 to allow passage of the slide 50 through the cover 13, as illustrated in FIG. 2.

Yet another embodiment of the invention might be used on the draw reed plate 12 where the presence of reeds 20 prohibits the use of a slide on the outside, as illustrated in FIG. 6. As shown in this embodiment, the slide comprises a tube or rod 70 which rides within a pair of bearings 71 and 72 fixed to the reed plate, in this case, the draw reed plate 60. The tube 70 further includes pads which slide into position to damp by immobilizing the draw reeds of positions 46, 48 and 49. This device must be compact in order to fit beneath the cover 14.

In the embodiment of FIG. 6, the slide includes two pads 73 and 74 which are positioned to damp the draw reeds in positions 46 and 48, respectively, when the slide 70 is moved to the left. A stop, such as a pin 75, may be placed in the tube to limit motion and place the damping pads directly over the reed slots and in contact with the reed when the device is slid to engage the pin with bearing 72. A spring 77 keeps the dampers disengaged in the resting position. One arm of the spring 77 engages with a pin in the tube 76 and the other arm is bent to fit into a hole in the reed plate. The fulcrum may be one of the screws used to hold the elements of the harp together. The slide 70 on the draw reed plate is coupled with the slide 50, previously described, that also limits motion of the two slides and positions the damping pads correctly.

In another embodiment of the spring mechanism, a coil spring can be inserted between the comb and the spacer that separates and couples the overblow and overdraw slides. The coil spring is held in holes drilled in the body and the spacer.

FIGS. 12 and 13 show yet another embodiment of the invention, wherein a damper pad 82 may be connected to a rotating bar 81, such that the reed is damped by the pad when the bar is rotated in one direction, in this case clockwise, FIG. 12, and the same reed is undamped when the bar is rotated in the opposite direction, in this case counterclockwise, FIG. 13, via a spring 83. A button 80 is attached to the damper pad 82 and protrudes through the cover plate 14. Pressing the button 80 rotates the damping pad into position to cover the reed slot 21.

The damper pads of FIG. 12 may be fabricated of polytetrafluoroethylene (Teflon®) or any other durable material suitable for the purpose of immobilizing and damping the harmonica reeds, such as brass, other metals, or molded materials.

In operation, the harmonica player plays the harmonica of the invention as would be done normally, except that the overblow and/or overdraw devices are used to more effectively achieve notes through overblowing and/or overdrawing, respectively. It is still necessary to alter critically resonance of the vocal tract, but the alterations are less critical and the tone is not contaminated by vibration of the other reed when the device is used.

If the harmonica player desires to achieve overblowing, the player pushes the overblow slide 50 of FIG. 2 into the harmonica until it reaches one of the stops which insures that the appropriate reeds are being effectively damped. The player simultaneously alters the vocal tract, predominantly with the tongue, in order to obtain the proper resonance and then blows into the desired hole, i.e. corresponding to 40, 43, 44 or 45. These draw reeds are directly opposite the damped reeds in positions 30, 33, 34, and 35, respectively. While the blow reed remains damped, the player overblows into a blow hole 17 communicating both with the damped blow reed, for example, in position 30, and with the opposite draw reed, for example, in position 40, thereby causing that draw reed to vibrate as an opening reed. At the end of the overblow sequence, the player may return the overblow slide 50 to its undamped or rest position, that is, to a position in which none of the reeds are damped. Preferably, this is accomplished by a spring previously described or other return means to simplify the playing of the harmonica. Similar procedures may be used with the overdraw slide.

When used according to the present invention, the ten hole diatonic harmonica can be played with a full chromatic range of up to 38 tones, from C-4 to C#-7 on a harp in the key of C, even by the intermediate player. The overblow and overdraw tones produced according to the invention are purer and clearer and require little practice to achieve.

The advantages of the invention are achieved by the embodiments and methods described, which enable the diatonic harmonica to be played more easily by producing more pure overdraw and overblow tones. While one embodiment disclosed incorporates a slide for this purpose, and another damper pads, it is possible to use other means for damping reeds in order to achieve the improved properties of the invention.

Whereas particular embodiments of the invention have been described above for purposes of illustration, it will be appreciated by those skilled in the art that numerous variations of the details may be made without departing from the invention as described in the appended claims. While many objects and advantages of the invention have been set forth herein, it is understood that the invention is defined by the scope of the following claims, including equivalents thereof, not by the objects and advantages.

I claim:

1. A harmonica adapted for overblowing, comprising;

a body having a plurality of cavities therein for air passage, said body being positioned between a blow reed plate and a draw reed plate;

a housing within which said body, blow reed plate and draw reed plate are disposed;

said blow reed plate having a plurality of blow reed cells defined therein, each blow reed cell having a blow reed and a blow reed slot, each said blow reed slot being positioned adjacent one said body cavity to receive air blown into said body cavity;

said draw reed plate including a plurality of draw reed cells therein, each draw reed cell comprising a draw reed and a draw reed slot, each said draw reed slot being positioned adjacent one said body cavity to allow passage of air drawn through said body cavity; and said harmonica further including a damping means for damping at least one said blow reed without damping all said blow reeds, said damped blow reed being positioned opposite a said draw reed to be vibrated through overblowing; whereby damping of said blow reed will concentrate air flow into the cavity on said opposite draw reed to effect overblowing.

2. The harmonica of claim 1 wherein said harmonica is a diatonic harmonica.

3. A harmonica adapted for overblowing comprising;

a body having a plurality of cavities therein for air passage, said body being positioned between a blow reed plate and a draw reed plate;

a housing within which said body, blow reed plate and draw reed plate are disposed;

said blow reed plate having a plurality of blow reed cells defined therein, each blow reed cell having a blow reed and a blow reed slot, each said blow reed slot being positioned adjacent one said body cavity to receive air blown into said body cavity;

said draw reed plate including a plurality of draw reed cells therein, each draw reed cell comprising a draw reed and a draw reed slot, each said draw reed slot being positioned adjacent one said body cavity to allow passage of air drawn through said body cavity;

said harmonica further including a damping means for damping at least one said blow reed without damping all said blow reeds, said damped blow reed being positioned opposite a said draw reed to be vibrated through overblowing; and said damping means is a slide, said slide being slidably engaged and having at least one damping member adapted to close the blow reed slot of the blow reed being damped, thereby substantially preventing said damped blow reed from vibrating when air is blown into the body cavity adjacent said damped blow reed and causing substantially all of the air blown into said body opening to pass through the draw reed slot opposite said damped blow reed, causing the draw reed in said opposite draw reed slot to vibrate.

4. The harmonica of claim 3 wherein said damping means further includes a stop means for limiting the sliding motion of said slide in said harmonica.

5. The harmonica of claim 3 wherein said damping means includes return means for returning said slide to a rest position.

6. The harmonica of claim 3 wherein said slide includes four damping members for damping four blow reeds.

7. The harmonica of claim 3 wherein said slide is fabricated of metal, plastic, or graphite.

8. The harmonica of claim 3 wherein said slide includes a plurality of slots for receiving fastening means to slidably attach said slide to said blow reed plate.

9. The harmonica of claim 6 wherein said slide includes a sliding member to which each said damping member is connected at a substantially right angle to the sliding member.

10. The harmonica of claim 9 wherein said slide further includes a reinforcing member connecting said damping members, said reinforcing member being substantially parallel to said slide member and spaced therefrom.

11. The harmonica of claim 5 wherein said return means is a spring.

12. A harmonica adapted for overblowing comprising;

a body having a plurality of cavities therein for air passage, said body being positioned between a blow reed plate and a draw reed plate;

a housing within which said body, blow reed plate and draw reed plate are disposed:

said blow reed plate having a plurality of blow reed cells; defined therein, each blow reed cell having a blow reed and a blow reed slot, each said blow reed slot being positioned adjacent one said body cavity to receive air blown into said body cavity;

said draw reed plate including a plurality of draw reed cells therein, each draw reed cell comprising a draw reed and a draw reed slot, each said draw reed slot being positioned adjacent one said body cavity to allow passage of air drawn through said body cavity;

said harmonica further including a damping means for damping at least one said blow reed without damping all said blow reeds, said damped blow reed being positioned opposite a said draw reed to be vibrated through overblowing; and said damping means is a rod having at least one damping pad for damping at least one said draw reed.

13. The harmonica of claim 12 wherein said rod is rotatable to position said damping pad in a damped position and a rest position.

14. The harmonica of claim 13 wherein said rod is adapted with a return means for returning said damping pad to said rest position from said damped position.

15. The harmonica of claim 14 wherein said return means comprises a spring.

16. A harmonica adapted for overblowing and further adapted for overdrawing, comprising;

a body having a plurality of cavities therein for air passage, said body being positioned between a blow reed plate and a draw reed plate;

a housing within which said body, blow reed plate and draw reed plate are disposed;

said blow reed plate having a plurality of blow reed cells defined therein, each blow reed cell having a blow reed and a blow reed slot, each said blow reed slot being positioned adjacent one said body cavity to receive air blown into said body cavity;

said draw reed plate including a plurality of draw reed cells therein, each draw reed cell comprising a draw reed and a draw reed slot, each said draw reed slot being positioned adjacent one said body cavity to allow passage of air drawn through said body cavity;

said harmonica further including a damping means for damping at least one said blow reed without damping all said blow reeds, said damped blow reed being positioned opposite a said draw reed to be vibrated through overblowing, a second damping means for damping at least one of said draw reeds, without damping all of said draw reeds, and without occluding air passage through any of said body cavities, said damped draw reed being positioned opposite a said blow reed to be vibrated through overdrawing.

17. The harmonica of claim 16 wherein said second damping means is a slide, said slide being slidably engaged and having at least one damping member adapted to close the draw reed slot of the draw reed being damped, thereby substantially preventing said damped draw reed from vibrating when air is drawn into the body cavity adjacent said damped draw reed and causing substantially all of the air drawn into said body opening to pass through the blow reed slot opposite said damped draw reed, causing the blow reed in said opposite blow reed slot to vibrate.

18. The harmonica of claim 17 wherein said second damping means further includes a stop means for limiting the sliding motion of said second damping means in said harmonica.

19. The harmonica of claim 17 wherein said second damping means includes return means for returning said second damping means to a rest position.

20. The harmonica of claim 17 wherein said slide includes at least two damping members for damping two draw reeds.

21. The harmonica of claim 17 wherein said slide is fabricated of metal, plastic, or graphite.

22. The harmonica of claim 17 wherein said second damping means is slidably received by a milled space in the underside of the comb of said harmonica opposite said draw reed plate.

23. The harmonica of claim 20 wherein said second damping means includes a sliding member to which each said damping member is connected at a substantially right angle to the sliding member.

24. The harmonica of claim 19 wherein said return means is a spring.

25. The harmonica of claim 16 wherein said second damping means is a rod having at least one damping pad for damping at least one said draw reed.

26. The harmonica of claim 25 wherein said rod is rotatable to position said damping pad in a damped position and a rest position.

27. The harmonica of claim 26 wherein said rod is adapted with a return means for returning said damping pad to said rest position from said damped position.

28. The harmonica of claim 27 wherein said return means comprises a spring.

29. A method of overblowing a harmonica having a plurality of blow reeds and draw reeds, comprising the steps of:

a. damping at least one blow reed positioned opposite a draw reed to be vibrated through overblowing, without damping all of said blow reeds; and b. while said blow reed remains damped, overblowing into a blow hole in said harmonica, said blow hole communicating with said damped blow reed and said opposite draw reed, thereby causing said opposite draw reed to vibrate, whereby damping of said blow reed will concentrate air flow into said blow hole to effect overblowing on said undamped draw reed.

30. The method of claim 29 wherein following step (b) said damped blow reed is undamped.

31. The method of claim 29 wherein said harmonica is a diatonic harmonica.

32. A method of overdrawing a harmonica having a plurality of blow reeds and draw reeds, comprising the steps of:

a. damping at least one draw reed positioned opposite a blow reed to be vibrated through overdrawing, without damping all of said draw reeds; and b. while said draw reed remains damped, overdrawing through a blow hole communicating with said damped draw reed and said opposite blow reed, thereby causing said opposite blow reed to vibrate, whereby damping of said draw reed will cause overdrawing through said blow hole to vibrate said undamped blow reed.

33. The method of claim 32 wherein following step (b) said damped draw reed is undamped.

34. The method of claim 32 wherein said harmonica comprises a diatonic harmonica.

* * * * *